US005924278A

United States Patent [19]

Burton et al.

[11] Patent Number: 5,924,278

[45] Date of Patent: Jul. 20, 1999

[54] PULSED PLASMA THRUSTER HAVING AN ELECTRICALLY INSULATING NOZZLE AND UTILIZING PROPELLANT BARS

[75] Inventors: Rodney L. Burton, Champaign, Ill.; Susan G. Delmedico, Mountain View, Calif.; Michael Wilson, Champaign, Ill.

[73] Assignee: The Board of Trustees of the University of Illinois, Urbana, Ill.

[21] Appl. No.: 08/832,293

[22] Filed: Apr. 3, 1997

Related U.S. Application Data

[51] Int. Cl.[6] ..... F03H 1/00

[52] U.S. Cl. ..... 60/203.1; 219/121.48

[58] Field of Search ..... 60/203.1, 202, 60/204; 313/231.31, 231.41; 219/121.48

[56] References Cited

U.S. PATENT DOCUMENTS

| | | | |
|---|---|---|---|
| 667,435 | 2/1901 | Greene et al. . | |
| 3,221,212 | 11/1965 | Gorowitz et al. . | |
| 3,239,130 | 3/1966 | Naundorf, Jr. . | |
| 3,360,682 | 12/1967 | Moore . | |
| 3,425,223 | 2/1969 | Browning . | |
| 3,447,322 | 6/1969 | Mastrup . | |
| 3,575,003 | 4/1971 | LaRocca . | |
| 3,636,709 | 1/1972 | La Rocca | 60/203.1 |
| 4,800,716 | 1/1989 | Smith et al. | 60/203.1 |
| 4,821,508 | 4/1989 | Burton et al. . | |
| 4,995,231 | 2/1991 | Smith et al. | 60/203.1 |
| 5,425,231 | 6/1995 | Burton . | |
| 5,611,947 | 3/1997 | Vavruska | 219/121.52 |

FOREIGN PATENT DOCUMENTS

| | | | |
|---|---|---|---|
| 3814331 | 11/1989 | Germany | 60/203.1 |

OTHER PUBLICATIONS

William Grant Seeglitz, "A Study of a Cylindrical, Pulsed, Solid Fuel Microthruster", pp. 1–175 (Feb. 1973).

Giorgio Paccani, "Anode–Nozzle Experimental Analysis in a Coaxial Non–Steady Solid Propellant MPD Thruster", pp. 438–445 (1988).

(List continued on next page.)

*Primary Examiner*—Timothy S. Thorpe
*Assistant Examiner*—Ted Kim
*Attorney, Agent, or Firm*—Wood, Phillips, VanSanten, Clark & Mortimer

[57] ABSTRACT

A thruster includes a body having a cavity with a discharge end, an apparatus for generating an electric arc having a current path through the cavity between first and second locations, and a non-gaseous, non-liquid propellant material (26) that forms an ionized gas as an incident of being heated. The propellant material (26) is heated by the electric arc to produce an ionized gas in the cavity. The cavity is configured to cause the ionized gas to be expelled from the cavity through the discharge end of the cavity in a flow path that is substantially parallel to the electric arc and current path within the cavity. A thruster includes a body having a cavity with a discharge end, a substantially non-ablating, electrically insulating nozzle (30) having an inlet disposed adjacent to the discharge end and an outlet, a first electrode (32) disposed within the cavity, a second electrode (34) disposed adjacent to the outlet of the nozzle, an electric power supply connected to the first and second electrodes to generate an electric arc having a current path therebetween, and a non-gaseous, non-liquid propellant material that forms an ionized gas as an incident of being heated. The propellant material is heated by the electric arc to produce an ionized gas in the cavity. A method of producing plasma to be used to propel a mass includes the steps of providing a cavity with a discharge end, providing a non-gaseous, non-liquid propellant material that forms an ionized gas as an incident of being heated, generating an electric arc having a current path through the cavity between first and second locations, heating the propellant material to produce an ionized gas in the cavity; and expelling the ionized gas from the cavity through the discharge end of the cavity in a flow path that is substantially parallel to the electric arc and current path within the cavity.

24 Claims, 5 Drawing Sheets

OTHER PUBLICATIONS

Kuang Yuan–Zhu, "Effects of Propellant Geometry on PPT Performance", pp. 685–690 (1984).
R.J. Vondra, "The MIT Lincoln Laboratory Pulsed Plasma Thruster", AIAA International Electric Propulsion Conference (1976).
D. Palumbo and W. Guman, "Effects of Propellant and Electrode Geometry on Pulsed Ablative Plasma Thruster Performance", AIAA 11th Electric Propulsion Conference (1975).
R. J. Vondra, "Analysis of Solid Teflon Pulsed Plasma Thruster", J. Spacecraft, vol. 7, pp. 1402–1406 (1970).
V. Zhurin, et al., "Electric Propulsion Research and Development in the USSR" (1976).
M. Andrenucci, et al., "Design of Solid Propellant MPD Thrusters" (1979).
G. Paccani et al., "Scale Effects On Solid Propellant MPD Thruster Performance", Joint Propulsion Conference & Exhibit, Jul. 13–15, 1998, Cleveland, OH, USA.

G. Paccani, "Non–Steady Solid Propellant MPD Experimental Analysis Concepts", 21st International Electric Propulsion Conference, Jul. 18–20, 1990, Orlando, FL.

G. Paccani et al., "Quasisteady Ablative Magnetoplasmadynamic Thruster Performance with Different Propellants", Journal of Propulsion and Power, vol. 14, No. 2, Mar.–Apr. 1998.

G. Paccani, "Experimental Analysis of a Coaxial Solid–Propellant MPD Thruster With Segmented Anodes", Sep., 1993.

G. Paccani et al., "Behaviour of Quasi–Steady Ablative MPD Thrusters With Different Propellants", 1995.

20
36
46
50
170
30
34
22
67
51
51
26
28
4
4
24
24
186
38
204
32
48
40
180
SPARK POWER SUPPLY 43
CONTROL CIRCUIT 44
THRUSTER POWER SUPPLY 42
PULSE FORMING NETWORK 236
MASS 68

PULSED PLASMA THRUSTER HAVING AN ELECTRICALLY INSULATING NOZZLE AND UTILIZING PROPELLANT BARS

STATEMENT REGARDING FEDERALLY SPONSORED RESEARCH/DEVELOPMENT

This invention was made with Government support under Naval Research Laboratory Grant No. N00014-95-1-G041 awarded by the Department of the Navy. The Government has certain rights in the invention.

CROSS-REFERENCE TO RELATED APPLICATIONS

Not applicable.

BACKGROUND OF THE INVENTION

1. Technical Field

The present invention is directed to a thruster for propulsion of a mass, and in particular to a pulsed plasma thruster for propulsion of a mass.

2. Background Art

Pulsed plasma thrusters used to propel spacecraft and satellites in outer space are old in the art. In a plasma thruster, a stream of partially or fully ionized gas particles, called a plasma, is used to produce thrust. In a pulsed plasma thruster, an electric arc generated by a pulsed electric discharge applied between two electrodes is used to heat a propellant material to produce the ionized gas particles or plasma.

The propellant material is conventionally either in a gaseous state or a solid state prior to heating. In a gas-type plasma thruster, an electric arc is conventionally passed through the gas to ionize the gas and produce plasma. See U.S. Pat. Nos. 5,425,231; 4,821,508 and 3,425,223. In a solid-type plasma thruster, the electric arc is passed over the surface of the solid material to increase the temperature of the material, thereby ablating the material to form an ionized gas. See U.S. Pat. No. 3,447,322; G. Paccani, Anode-Nozzle Experimental Analysis in a Coaxial Non-Steady Solid Propellant Thruster, Deutsche Gesellschaft fuer Luft-und-Raumfahrt (1988); and D. Palumbo and W. Guman, Effects of Propellant and Electrode Geometry on Pulsed Ablative Plasma Thruster Performance, AIAA 11th Electric Propulsion Conference, AIAA Paper 75–409 (1975).

It is desirable to exhaust the plasma from the thruster to produce thrust and to perform useful work, such as to change the orientation or speed of a spacecraft mass to which the thruster is attached. The plasma may be exhausted from a chamber under the pressure caused by the heating and/or ablation process (electrothermal effect). Alternatively, the flow of electric current between the first and second electrodes may cause the ionized particles to be exhausted under the influence of the electric and magnetic fields caused therebetween (electromagnetic effect).

The production of plasma in conventional pulsed plasma thrusters, however, has come at a significant cost. Typically, conventional pulsed plasma thrusters have had an efficiency of less than 10%. See R. Vondra et al., Analysis of Solid Teflon Pulsed Plasma Thruster, Journal of Spacecraft (1970). That is, less than 10% of the total energy consumed by the thruster is converted to a form (thrust) which can be used to perform work. The low efficiency of these plasma thrusters has been a significant disadvantage, considering that energy consumption has always been a critical consideration in spacecraft design.

Palumbo and Guman describe a number of pulsed plasma thrusters which are claimed to have improved efficiency. In these thrusters, an electric arc is generated between two oppositely charged plate electrodes to heat two solid propellant bars disposed therebetween. With heating, the surfaces of the solid propellant rods are ablated, and an ionized gas is formed in a cavity or space defined by the surfaces of the electrodes and the bars. In all of the thrusters shown, the current path of the electric arc between the oppositely charged plates is perpendicular to the flow path of the gas generated by ablation of the solid propellant. Furthermore, in all of the thrusters shown, the space or cavity between the propellant bar surfaces is on the order of 1.7 cubic inches (28 cubic centimeters).

Paccani also describes a pulsed plasma thruster claimed to have improved efficiency. This thruster uses a coaxial arrangement of electrodes to heat and ablate a propellant material disposed therebetween to produce plasma. In all of the thrusters shown, the current path of the electric arc between the oppositely charged electrodes is substantially perpendicular to the flow path of the plasma produced from the solid propellant. Furthermore, after the plasma has passed through the space between the two electrodes, the plasma is exhausted out of a nozzle which is made of conductive material and formed integrally with one of the coaxial electrodes.

U.S. Pat. No. 3,447,322 describes a pulsed plasma thruster having first and second electrodes disposed at alternate ends of a cavity formed of a propellant material. The propellant material is heated in the cavity by an electric arc generated between the electrodes to produce plasma. The plasma is exhausted out of a nozzle which is made of conductive material and formed integrally with one of the electrodes. It is believed that the electric discharge is pulsed such that the gas is exhausted through the nozzle during the periods when no electric discharge occurs between the electrodes.

BRIEF SUMMARY OF THE INVENTION

In an embodiment of the present invention, a thruster includes a body having a cavity with a discharge end, an apparatus for generating an electric arc having a current path through the cavity between first and second locations, and a non-gaseous, non-liquid propellant material that forms an ionized gas as an incident of being heated. The propellant material is heated by the electric arc to produce an ionized gas in the cavity. The cavity is configured to cause the ionized gas to be expelled from the cavity through the discharge end of the cavity in a flow path that is substantially parallel to the electric arc and current path within the cavity.

Moreover, the non-gaseous, non-liquid propellant material may define at least a portion of the cavity.

Moreover, the thruster may include a nozzle made of a substantially non-ablating electrically insulating material with an inlet disposed adjacent to the discharge end of the cavity and an outlet. The electric arc and the current path may pass through the cavity and the nozzle, the ionized gas being expelled through the nozzle in a flow path that is substantially parallel to the electric arc and the current path within the nozzle. Furthermore, the nozzle may be made of boron nitride. Additionally, the apparatus for generating an electric arc may include a first electrode disposed within the cavity and adjacent to the propellant material, a second electrode disposed adjacent to the outlet of the nozzle, and an electric power supply connected to the first and second electrodes. Moreover, the electric power supply may have incorporated therein a pulse forming network to generate an electric discharge for a predetermined pulse width and at a predetermined repetition rate between the first and second electrodes to generate the electric arc having the current path through the cavity, the predetermined pulse width being between approximately 1 and 100 microseconds and the repetition rate being between approximately 0.1 and 10 Hz.

In another embodiment of the invention, a thruster includes a body having a cavity with a discharge end, a substantially non-ablating, electrically insulating nozzle having an inlet disposed adjacent to the discharge end and an outlet, a first electrode disposed within the cavity, a second electrode disposed adjacent to the outlet of the nozzle, an electric power supply connected to the first and second electrodes to generate an electric arc having a current path therebetween, and a non-gaseous, non-liquid propellant material that forms an ionized gas as an incident of being heated. The propellant material is heated by the electric arc to produce an ionized gas in the cavity.

Moreover, the non-gaseous, non-liquid propellant material may define at least a portion of the cavity.

Moreover, the nozzle may be made of boron nitride.

Moreover, the electric power supply may have incorporated therein a pulse forming network to generate an electric discharge for a predetermined pulse width and at a predetermined repetition rate between the first and second electrodes to generate the electric arc having the current path through the cavity, the predetermined pulse width being between approximately 1 and 100 microseconds and the repetition rate being between approximately 0.1 and 10 Hz.

Moreover, the body may have a first passage formed therein, the first passage in communication with the cavity, and the propellant material may have a bar form, the bar disposed in the first passage with a first surface of the bar defining at least a portion of the cavity. Furthermore, the thruster may include an apparatus for feeding the bar of propellant material through the passage towards the cavity as the propellant material is heated to produce an ionized gas. Additionally, the apparatus for feeding the bar of propellant material into the passage may include a spring with spaced ends, with one end of the spring attached to the body and the other end of the spring abutting a surface of the bar of propellant material.

Moreover, the body may have a plurality of passages formed therein, the plurality of passages in communication with the cavity, and the propellant material includes a plurality of bars, the plurality of bars disposed in the plurality of passages, each bar having a surface which defines at least a portion of the cavity. Furthermore, the first electrode may extend at least partially into the cavity and is disposed between the surfaces of at least two of the bars which define at least a portion of the cavity, and the surfaces of at least two bars and a surface of the first electrode at least partially define the cavity. Additionally, the thruster may include an apparatus for feeding the plurality of bars of propellant material through the plurality of passages towards he cavity as the propellant material is heated to produce ionized gas.

Moreover, the thruster may include an apparatus for generating an electric spark adjacent to the outlet of the nozzle, the spark initiating the generation of the electric arc between the first and second electrodes.

Moreover, the thruster may include a pair of D-shaped pieces disposed within the body, the D-shaped pieces defining a part of the cavity.

In a further embodiment of the invention, a method of producing plasma to be used to propel a mass includes the steps of providing a cavity with a discharge end, providing a non-gaseous, non-liquid propellant material that forms an ionized gas as an incident of being heated, generating an electric arc having a current path through the cavity between first and second locations, heating the propellant material to produce an ionized gas in the cavity; and expelling the ionized gas from the cavity through the discharge end of the cavity in a flow path that is substantially parallel to the electric arc and current path within the cavity.

Moreover, the step of providing a non-gaseous, non-liquid propellant material may include the step of providing a non-gaseous, non-liquid propellant material that defines at least a portion of the cavity.

DETAILED DESCRIPTION OF THE INVENTION

Figure 1:
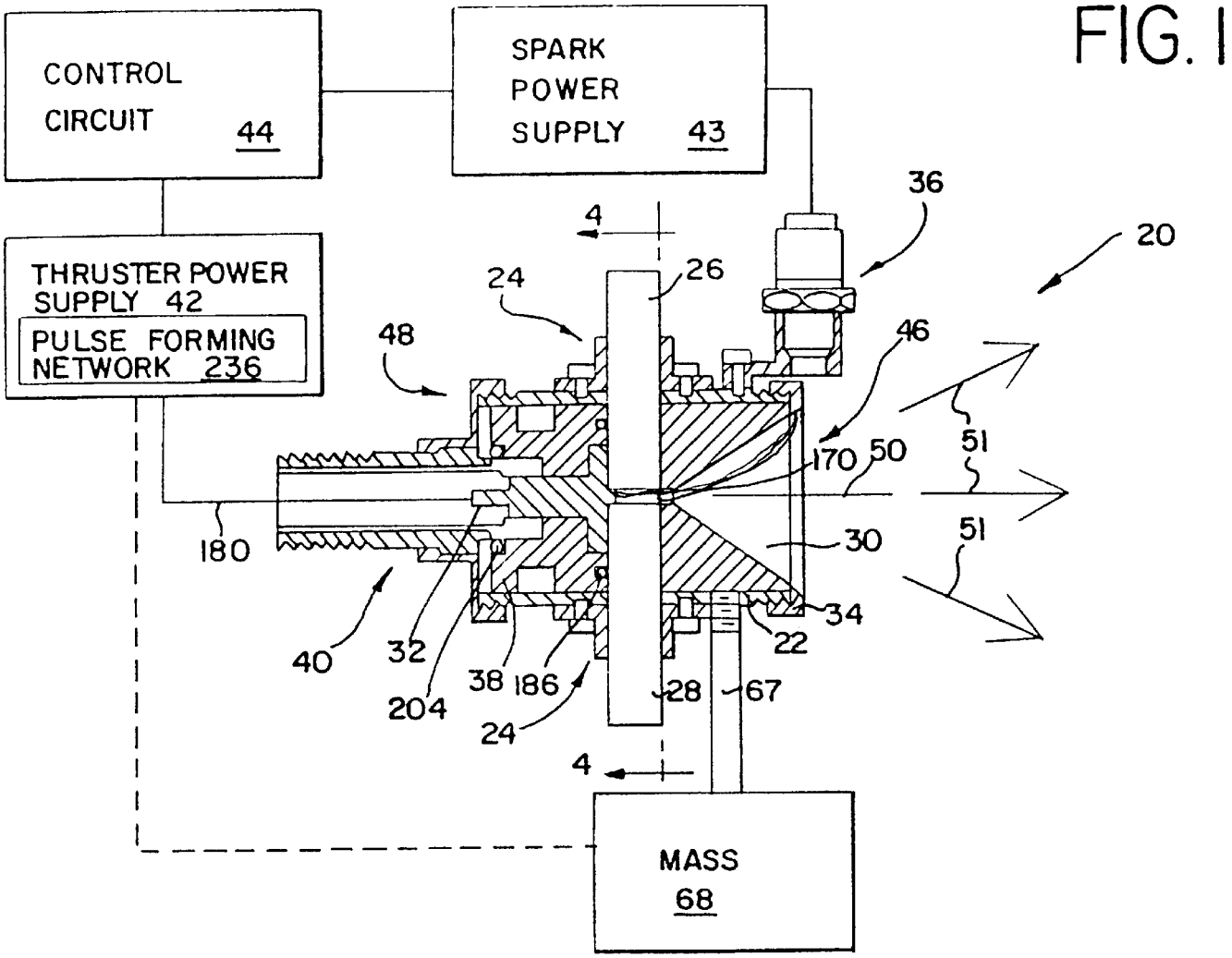
FIG. 1 is a cross-sectional view of a pulsed plasma thruster according to an embodiment of the present invention.

One embodiment of the present invention is shown in FIGS. 1–4. Referring first to FIG. 1, a pulsed plasma thruster 20 includes a body or housing 22 to which is attached a propellant bar feeding apparatus 24, propellant bars 26, 28, a nozzle 30, inner and outer electrodes 32, 34, a spark generating apparatus 36, a spacer 38, and an electrical connecting apparatus 40. A thruster power supply 42 is connected to first and second electrodes 32, 34 by a cable connected to the electrical connecting apparatus 40. Similarly, a spark power supply 43 is attached to the spark generating apparatus 36 by a cable. The thruster power supply 42 and the spark power supply 43 are, in turn, connected to a control circuit 44, which may be connectable to a user input/output device (not shown) so as to be programmable. Alternatively, the control circuit may be preprogrammed to control the electric discharge between the electrodes 32, 34 and the firing of the spark generating apparatus 36.

The thruster 20 is assembled by securing the bar feeding apparatus 24 to the body 22. Bars 26, 28 are then disposed within the bar feeding apparatus 24, and into the body 22. The nozzle 30 is disposed into one end 46 of the body 22 so as to abut the bars 26, 28. The electrode 34 is secured to the body 22 to maintain the nozzle 30 in its axial position. The electrode 32 is disposed into the other end 48 of the body 22 so as to abut and space the ends of the bars 26, 28. The spacer 38 is disposed in the body 22 abutting the electrode 32 and bars 26, 28. The electric connecting apparatus 40 is then secured to the body 22 to maintain the spacer 38 and the electrode 32 in their axial positions within the body 22. Lastly, the spark generating apparatus 36 is secured to the body 22 at the end 46.

In operation, a voltage on the order of 1500 volts is applied across the electrodes 32, 34 by the thruster power supply 42 under the control of the control circuit 44. The control circuit 44 then signals the spark power supply 43 to fire the spark generating apparatus 36, thereby causing a breakdown arc to form between the electrodes 32, 34 preferably with an amplitude of approximately 200 to 50,000 amperes, a pulse width of approximately 1 to 100 microseconds, and a repetition rate of 0.1 to 10 pulses per second (Hz). The arc heats the bars 26, 28 so that ionized gas forms, exiting outwardly under electrothermal and electromagnetic forces along an axis 50 in the direction indicated by arrows 51.

Turning now to the elements of the thruster 20 in greater detail the cylindrically-shaped body 22 has a wall 52, preferably made of aluminum. The body 22 also has external threads 54, 56 formed at the ends 46, 48. The body 22 also has two equally-sized, facing, rectangularly-shaped openings 58, 60 formed in the wall 52. These openings 58, 60 allow bars 26, 28 to be disposed with an end 62, 64 within the body 22. A threaded mounting hole 66 is also formed in the body 22 so that the body 22 can be mounted by a mount 67 to a mass 68, such as a spacecraft or satellite.

The bars 26, 28 are of a non-gaseous, non-liquid propellant material. Preferably, the bars 26, 28 are have a uniform rectangular cross-section and are made of a solid TEFLON material. Alternatively, the propellant material may take on any shape and be made of any suitable non-gaseous, non-liquid material, including, for example, those materials typically classified as viscoelastic materials, i.e. material which are elastic and viscous. See W. Findley, et al., Creep and Relaxation of Nonlinear Viscoelastic Materials 2–3 (1976), which is herein incorporated by reference. The viscoelastic materials may be in the form of a gel or a paste. Suitable changes would be made to the feeding apparatus 24 as are known to one of ordinary skill in the art to allow incorporation of such various shapes and materials.

Disposed within the body 22 are two D-shaped pieces 69. The pieces 69 are formed of a high-temperature, electrically insulating material such as boron nitride. The D-shaped pieces 69 have a radius of curvature to form an effective diameter slightly smaller that of wall 52, and are disposed approximately equidistantly from the ends 46, 48 of the body 22. The pieces 69 abut the bars 26, 28 on either side to space and align the bars 26, 28 within the body 22, and to perform other functions as explained in greater detail below. The pieces 69 may be urged against the bars 26, 28 through the use of washer springs (not shown) disposed between the pieces 69 and the wall 52 of the body 22.

Figure 4:
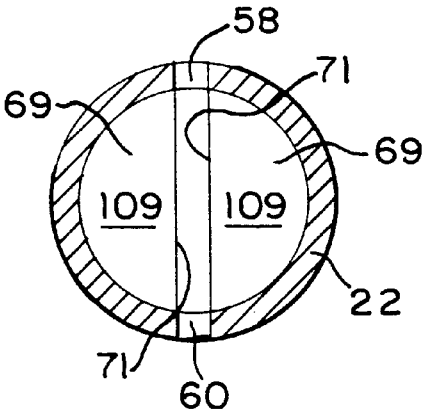
FIG. 4 is a cross-sectional view of the thruster shown in FIG. 1 taken about line 4—4.
Figure 4A:
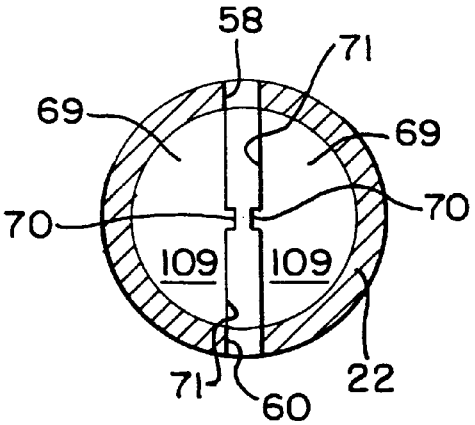
FIG. 4A is a cross-sectional view of a pulsed plasma thruster according to a further embodiment of the present invention.

Alternatively, the pieces 69 may be formed with extensions 70 as shown in FIG. 4A. The extension 70 depend from the surface 71 of the plates 69 in a radially inward direction.

Figure 7:
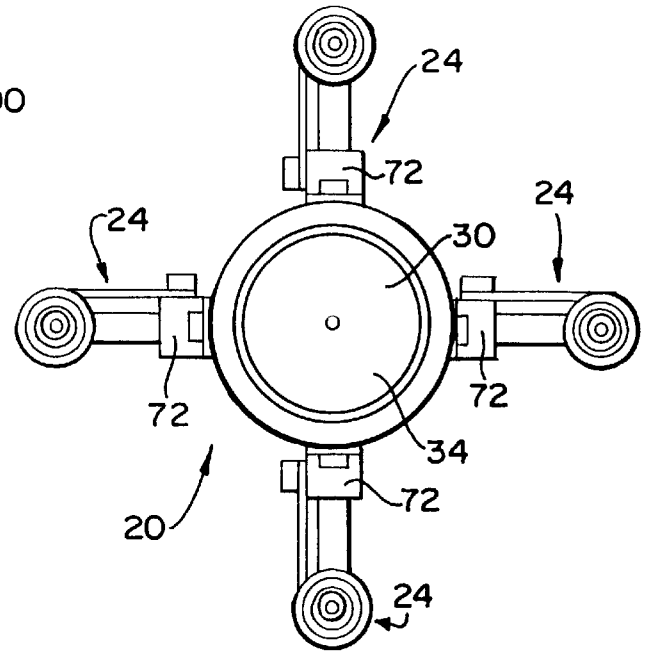
FIG. 7 is a front elevation view of a pulsed plasma thruster according to a further embodiment of the present invention with four propellant bars and guides.
Figure 5:
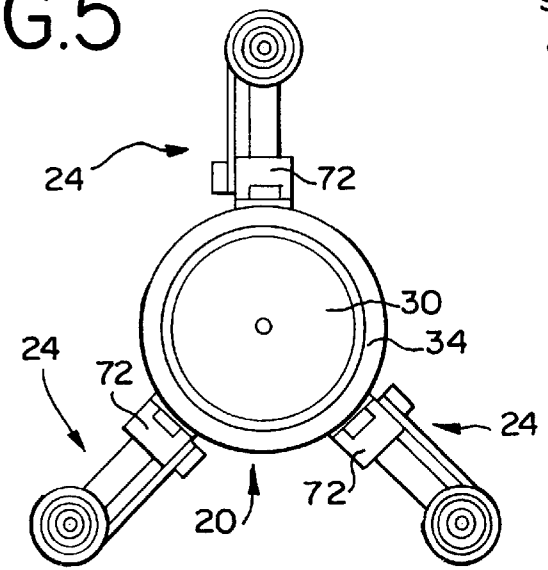
FIG. 5 is a front elevation view of a pulsed plasma thruster according to another embodiment of the present invention with three propellant bars and guides.
Figure 6:
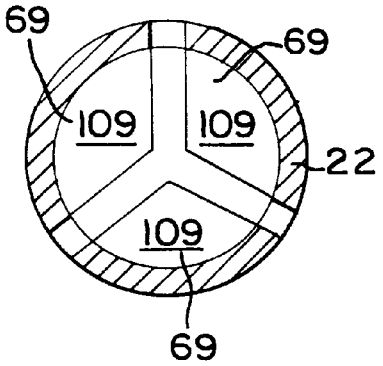
FIG. 6 is a cross-sectional view of the thruster shown in FIG. 5.
Figure 8:
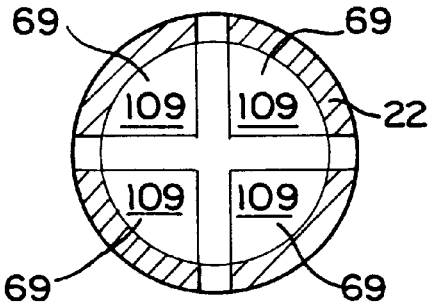
FIG. 8 is a cross-sectional view of the thruster shown in FIG. 7.

As a further alternative, if more than two bars of propellant material are used, the shape of the pieces 69 may be varied accordingly to space and align the bars, as shown in FIGS. 5–8. FIGS. 5 and 6 show an alternative embodiment in which three bars of propellant material are used, while FIGS. 7 and 8 show an alternative embodiment in which four bars of propellant material are used. As shown, the bars are equally spaced about the body 22.

The bar feeding apparatus 24 includes guide blocks or guides 72 attached to the body 22 using screws 74, which are passed through holes 76 formed in the guides 72 and then screwed into internally threaded holes 78 formed in the wall 52 of the body 22, and in particular in an outer surface 80 of the body 22. The guides 72 are preferably formed from nylon. The guides 72 have rectangularly-shaped passages 82, 84 formed therethrough, which rectangularly-shaped passages 82, 84 are substantially equally-sized to the openings 58, 60 formed in the wall 52 of body 22. With the guides 72 attached to the body 22, the passages 82, 84 are substantially aligned with the openings 58, 60 and help to align bars 26, 28 which are disposed therethrough.

The bar feeding apparatus 24 also includes spiral coiled springs 86, 88 attached to the guides 72 at first ends 90, 92 of the springs 86, 88. Preferably, screws 94, 96 are used to secured the first ends 90, 92 of the springs 86, 88 to the guides 72. As shown, the springs 86, 88 contact ends 98, 100 of the bars 26, 28 along surfaces 102, 104 of the springs 86, 88. The springs 86, 88 urge the bars 26, 28 radially inward relative to the axis 50.

Figure 2:
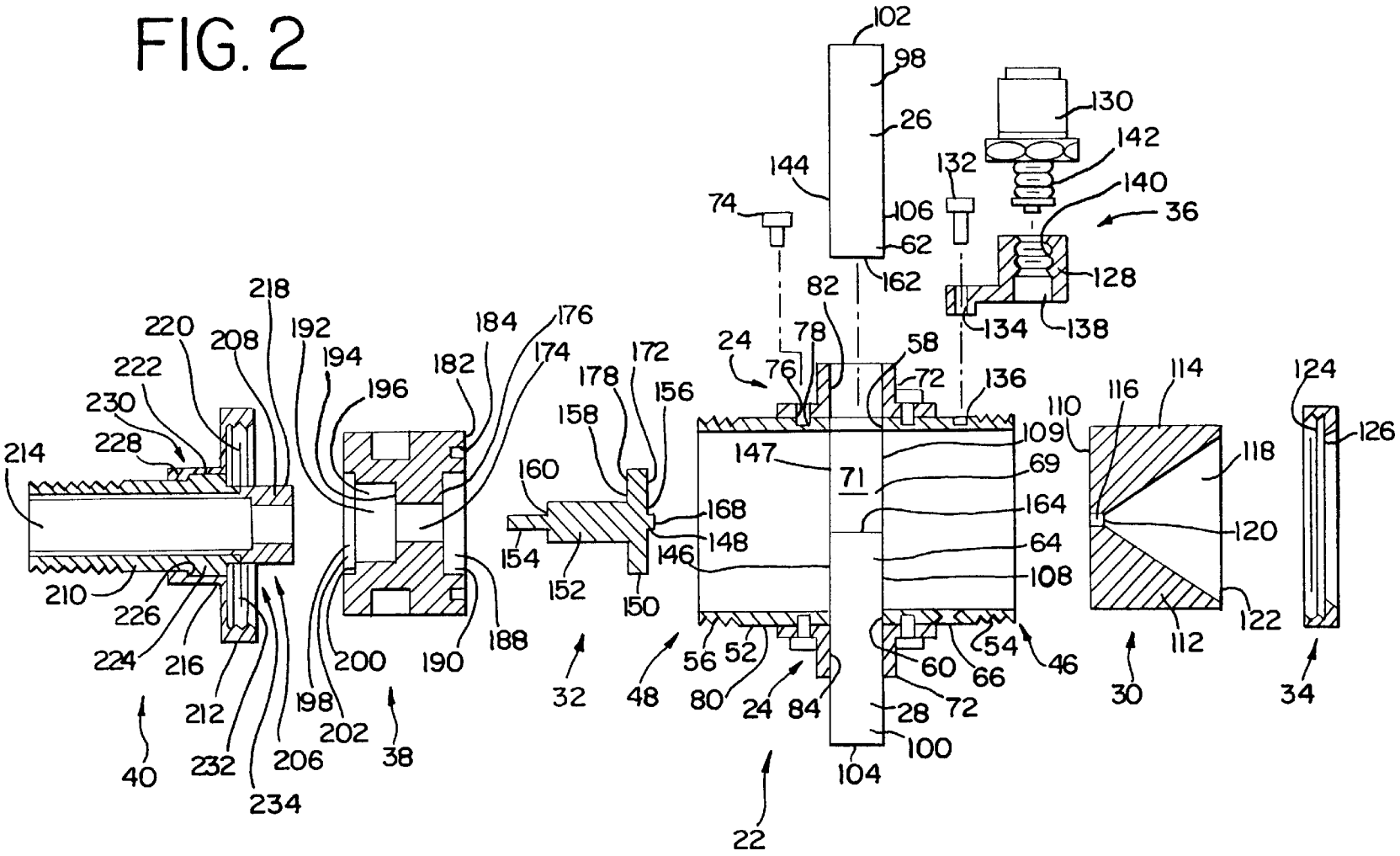
FIG. 2 is an enlarged, exploded cross-sectional view of the thruster shown in FIG. 1.
Figure 3:
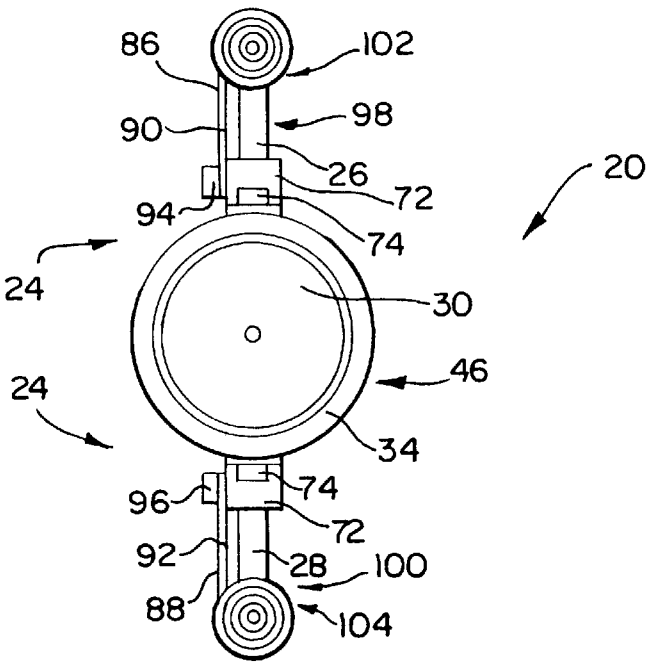
FIG. 3 is a front elevation view of the thruster shown in FIG. 1, with a spark generating apparatus removed to show the details of a bar feeding apparatus.

As shown in FIG. 2, the bar feeding apparatus includes two guides 72 and two springs 86, 88. Alternatively, in the embodiments wherein more than two bars of propellant material are used, more than two guides 72 and springs may be used. For example, FIGS. 5 and 6 show an embodiment of the present invention wherein three guides 72 and springs are used, and FIGS. 7 and 8 show an embodiment of the present invention wherein four guides 72 and springs are used.

The nozzle 30 abuts a first side 106, 108 of the ends 62, 64 of the bars 26, 28 and outwardly axially facing ends 109 of the D-shaped pieces 69 along an inner nozzle end 110. The nozzle 30 is preferably formed of a high-temperature, electrically insulating material, such as boron nitride. The nozzle 30 includes a nozzle body 112 having a first surface 114, a second surface 116, and a third surface 118. The first surface 114 is cylindrically-shaped and has an effective diameter slightly smaller than the internal diameter of the wall 52 of body 22. The second surface 116 is also cylindrically-shaped with a circular cross-section of substantially uniform area. The third surface 118 is conically-shaped with a circular cross-section of substantially increasing area from an interface 120 between the second and third surfaces 116, 118 to an outer end 122 of the nozzle 30. In this manner, the nozzle 30 defines a diverging-type nozzle, although other types of nozzles may be used.

Abutting the outer end 122 of the nozzle 30 is the outer electrode 34. The outer electrode 34 is made of an electrically conducting material, preferably brass, and is formed as a ring-shaped collar. The outer electrode 34 has an internal thread 124 that mates with the external thread 54 formed in the outer surface 80 of the body 22. The outer electrode 34 is secured to the body 22 by screwing the electrode 34 onto the body 22 at end 46. The outer electrode 34 also has an axially inwardly facing rim 126 which abuts the outer end 122 of the nozzle 30, thereby substantially fixing the axial position of the nozzle 30 within the body 22.

Disposed adjacent to the outer electrode 34 is the spark-generating apparatus 36. The spark-generating apparatus 36 includes a mounting guide 128 and a spark plug 130, preferably of the semiconductor-type. The mounting guide 128 is secured to the body 22 of the thruster 20 by means of a fastener 132, such as a screw, which is passed through an opening 134 formed in the guide 128 and into a threaded hole 136 formed in the outer surface 80 of the body 22. The mounting guide 128 has a passage 138 formed therethrough, with an internal thread 140 formed therein. The spark plug 130, having an external thread 142, is secured to the mounting guide 128 by screwing the spark plug 130 into the internally-threaded passage 138. With the spark plug 130 secured in the mounting guide 128, and the mounting guide 128 attached to the body 22, the spark plug 130 is disposed adjacent to the outer electrode 34.

The inner electrode 32 is disposed along a second side 144, 146 of the ends 62, 64 of the bars 26, 28 and inwardly axially facing ends 147 of the D-shaped pieces 69. The inner electrode 32 is made of an electrically conducting material, preferably brass. The inner electrode 32 has a stepped-shape formed of a series of cylindrical sections 148, 150, 152 and 154 set off by shoulders 156, 158, and 160.

The first cylindrical section 148 is typically 0.125 inches (0.318 cm) in diameter, and may be disposed between facing surfaces 162, 164 of the bars 26, 28 so as to space the bars 26, 28. Alternatively, the radially inwardly depending extensions 70 of the D-shaped pieces 69 (FIG. 4A) may be used to space the facing surfaces 162, 164 of the bars 26, 28. The spaced facing surfaces 162, 164, the D-shaped pieces 69, and an axially outwardly facing surface 168 of the cylindrical section 148 cooperatively define a cavity 170.

The cavity 170 defined therebetween is roughly rectangular in shape, having an effective width of 0.25 inches (0.635 cm), height of 0.125 inches (0.318 cm) and a length of approximately 0.5 inches (1.27 cm). The cavity thus has a volume of approximately 0.016 cubic inches (0.25 cubic centimeters).

The second cylindrical section 150, and in particular an axially outwardly facing surface 172 thereon, abuts the second sides 144, 146 of the bars 26, 28 to help align the bars 26, 28 within the body 22, and also abuts the ends 147 of the D-shaped pieces 69. The third cylindrical section 152 is disposed in a throughpassage 174 formed in the spacer 38, preferably with an axially outwardly facing surface 176 of the spacer 38 abutting an axially inwardly facing surface 178 of the second cylindrical section 150 so as to align and position the electrode 32 within the body 22 and relative to the bars 26, 28. The fourth cylindrical section 154 forms a connective pin for attachment to the power supply 42 via a cable 180, such as a coaxial cable.

The spacer 38 also abuts the second side 144, 146 of the ends 62, 64 of the bars 26, 28 and the ends 147 of the D-shaped pieces 69 along an axially outwardly facing surface 182. The spacer 38 is preferably made of an electrically insulating material, such as boron nitride. An annular groove 184 is formed in the axially outwardly facing surface 182, and an O-ring 186 is disposed therein. The O-ring 186 is intended to limit or prevent gas generated in the cavity 170 from leaking out between the axially outwardly facing surface 182 of the spacer 38 and the axially inwardly facing surfaces 144, 146 of the bars 26, 28.

The spacer 38 also has the stepped throughpassage 174 previously discussed. The stepped passage 174 has a number of different diameter sections. In particular, a first section 188 of the passage 174 is defined in part by the axially outwardly facing surface 176 and also by a radially inwardly facing surface 190. The second cylindrical section 150 of the electrode 32 is disposed within the first section 188 with the axially inwardly facing surface 178 of the second cylindrical section 150 abutting the axially outwardly facing surface 176 of the spacer 38. A second section 192 is defined by an axially inwardly facing surface 194 and a radially inwardly facing surface 196. A third section 198 is contiguous with the second section 192, and is defined by an axially inwardly facing surface 200 and a radially inwardly facing surface 202. As shown, an O-ring 204 is disposed in the third section 198 to provide additional sealing to prevent leakage of the gas from the cavity 170 into the electrical connecting apparatus 40.

The spacer 38 is maintained in its axial position in the body 22 of the thruster 20 abutting the bars 26, 28 and pieces 69 through the cooperation of the axially inwardly facing surface 194 and/or radially inwardly facing surface 196 of the second section 192 of the spacer 38 and the axially outwardly extending end 206 of the electrical connecting apparatus 40. The electrical connecting apparatus 40 includes a stepped, electrically insulating insert 208, a threaded, electrically conducting tube 210, and a stepped, electrically conducting locking collar 212.

The insert 208 is generally cylindrical in shape, with a passage 214 formed therethrough. As explained above, the first end 206 fits within the second section 192 formed in the spacer 38 and cooperates with the spacer 38 to maintain the spacer 38 consistently axially and radially positioned. The first end 206 also has a inwardly facing, stepped shoulder 216 formed on a surface 218 at the first end 206.

The treaded conducting tube 210 surrounds a part of the insert 208. Similar to the insert 208, the conducting tube 210 is a stepped cylinder, having axially inwardly and outwardly facing surfaces 220, 222 disposed about a stepped region 224. The axially inwardly facing surface 220 abuts an axially outwardly facing surface 226 formed on a rim 228 of the locking collar 212.

The locking collar 212 is disposed about the conducting tube 210 and insert 208, and cooperates with the threaded end 56 of the body 22 to maintain the electrode 32, spacer 38, and electrical connecting apparatus 40 in an operative position relative to the bars 26, 28 and the D-shaped pieces 69. In addition to the rim 228 formed in an inward end 230 of the locking collar 212, the locking collar 212 has an internal thread 232 formed in an outward end 234. The locking collar 212 is secured to the body 22 by screwing the external thread 56 of the body 22 into the internal thread 232 of the locking collar 212.

Alternatively, a steel spring (not shown) may be located in the body 22 between the locking collar 212 and the spacer 38 to maintain the electrode 32 and spacer 38 in an operative position relative to the bars 26, 28 and D-shaped pieces 69.

In operation, the control circuit 44, of technology known to those of skill in the art, signals the power supply 42 to charge an internal storage capacitor to a first voltage. When or after the first voltage is reached, the control circuit signals the power supply 43 to fire the spark plug 130. The firing of the spark plug 130 adjacent to the electrode 34 causes a breakdown arc, driven by the current from the storage capacitor (not shown) and an associated pulse forming network 236, to form between the electrode 34 and the electrode 32. The arc passes through the nozzle 30 and the cavity 170, close to the facing surfaces 162, 164 on the bars 26, 28. As the arc passes over the surfaces 162, 164, the propellant material at the surfaces 162, 164 is heated past the temperature at which the solid TEFLON propellant material forms an ionized gas, typically 10,000–20,000 degrees Kelvin. The arc may be of a single pulse, or may be of a series of pulses, each pulse having, for example, a pulse width of approximately 1 to 100 microseconds and a repetition rate of approximately 0.1–10 pulses per second (Hz).

It is theorized that the positioning of the electrodes 32, 34 at opposite ends of the nozzle 30, rather than at opposite ends of the cavity 170 provides for an electric current path through the cavity 170 and nozzle 30 that is substantially parallel to the flow of the plasma out of the cavity 170 in the direction of the arrow 50, except in the region immediately adjacent to the electrode 34. It is further theorized that by having the electric current path running parallel to the direction of the plasma flow in the cavity 170 and nozzle 30, greater efficiencies are achievable. This parallel path theory is contrary to the conventional solid thruster design, which emphasizes current flow perpendicular to the plasma flow.

As the gas forms in the cavity 170, the gas pressure within the cavity 170 builds, typically to a level of 10–100 atmospheres, forcing the ionized gas or plasma outward from the cavity 170 in the direction of the arrow 50. Because of the considerable small cavity in which the gas is being formed, the pressures in the cavity 170 are in excess of 50 times the conventional pressures. It is theorized that the high pressures suppress multiple ionization of the propellant, promote radiation heat transfer to the propellant surface to abet heating, and provide adequate numbers of molecular collisions to permit recovery of the propellant gas energy in the nozzle 30. Additionally, electric and magnetic fields produced by the electrodes 32, 34 cause the ionized gas to accelerate further as it exits the thruster 20.

With the cavity 170 as described above, the electrothermal effects may provide approximately 80% kinetic energy to the plasma stream, while electromagnetic effects may provide approximately 20%. With an embodiment constructed as shown in FIGS. 1–4, an efficiency in excess of 20% of the energy put in to the thruster 20 can be had.

Figure 10:
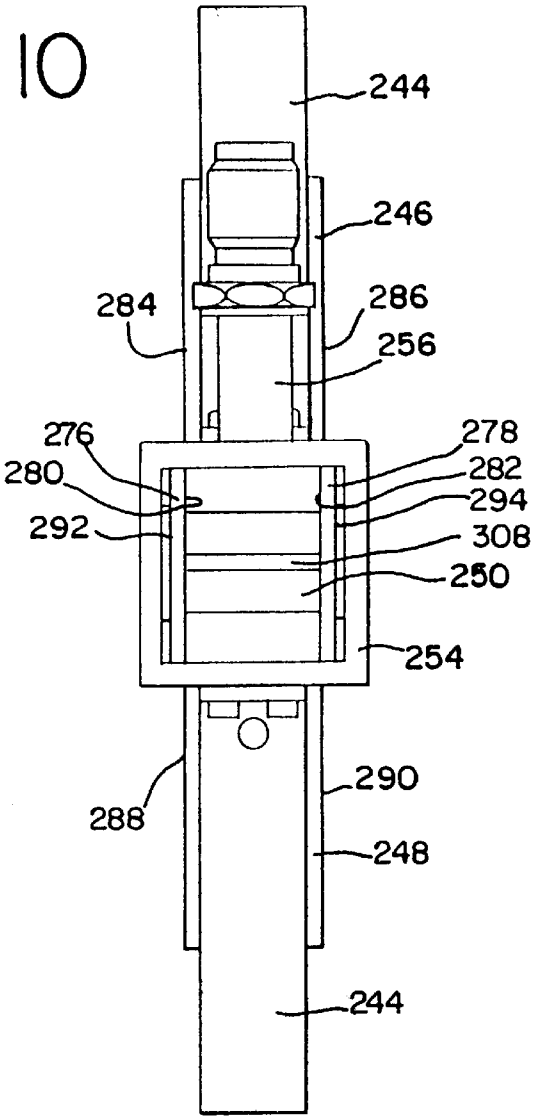
FIG. 10 is a front elevation view of the pulsed plasma thruster shown in FIG. 9.
Figure 9:
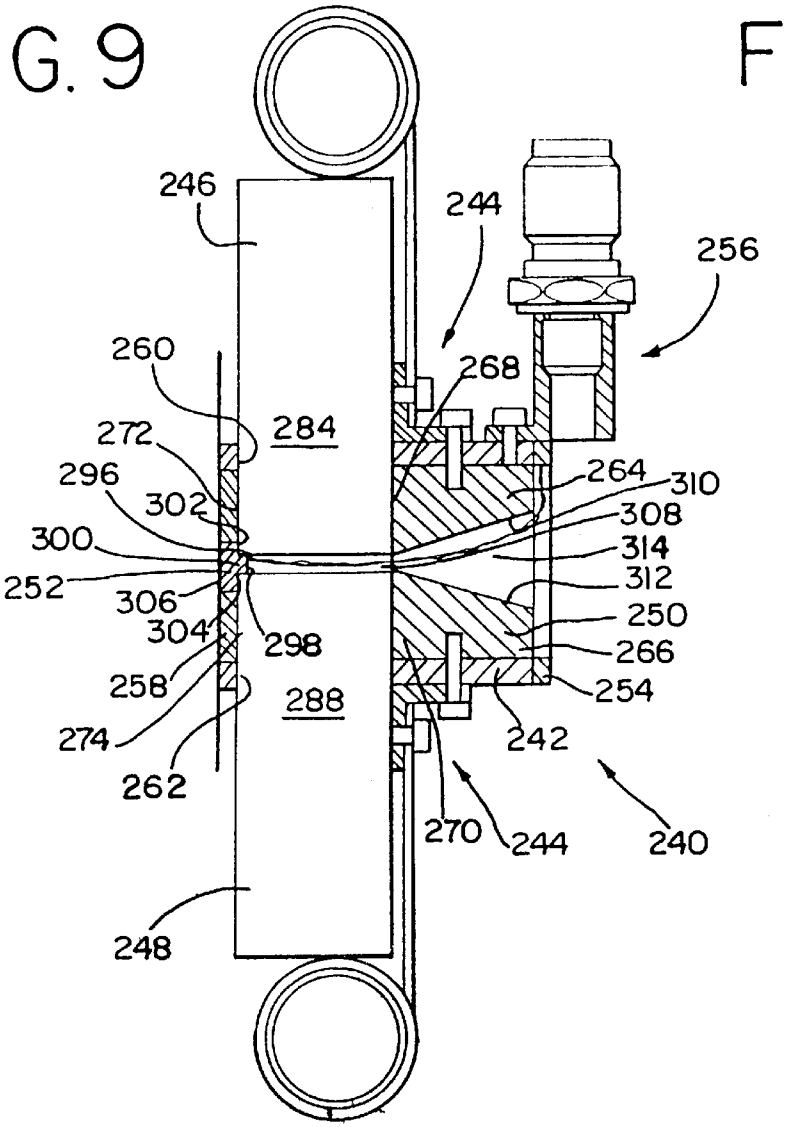
FIG. 9 is a partial cross-sectional view of a pulsed plasma thruster according to still another embodiment of the present invention.

A further embodiment of the present invention is shown in FIGS. 9 and 10. A thruster 240 includes a body 242 to which is attached a bar feeding apparatus 244, bars 246, 248, a nozzle 250, electrodes 252, 254, a spark generating apparatus 256, and a spacer 258. The thruster 240 would also include an electrical connecting apparatus, thruster and spark power supplies and a control circuit. These elements are not shown in FIGS. 9 and 10, but would be substantially similar in structure and function to the electrical connecting apparatus 40, thruster power supply 42, spark power supply 43, and control circuit 44 shown above for the thruster 20 in FIGS. 1 and 2.

The body 242 is formed of a conduit having a rectangular cross-section, and preferably of a conducting material, such as aluminum. The body 242 has openings 260, 262 through which bars 246, 248 are disposed. The nozzle 250, preferably of boron nitride, having upper and lower nozzle sections 264, 266, is secured within the body 250 and abuts the bars 246, 248 along a first side 268, 270 thereof. The electrode 252 and the spacer 258 are also disposed within the body 242, and abut a second side 272, 274 of the bars 246, 248. Additionally, side plates 276, 278 are disposed within the body 242 and have facing surfaces 280, 282 which abut the bars 246, 248 along third and fourth sides 284, 286, 288, 290. The plates 276, 278 may be forced tightly against the bars 246, 248 through the use of washer springs 292, 294.

The bars 246, 248 also have facing surfaces 296, 298, which are separated by the end 300 of the electrode 252. In particular, surface 296 abuts a shoulder 302 of the electrode 252, while the surface 298 abuts a shoulder 304. Thus separated, the facing surfaces 296, 298 of the bars 246, 248, the facing surfaces 280, 282 of the plates 276, 278 and an axially outwardly facing surface 306 of the electrode 252 define a cavity 308. Similarly, the upper and lower sections 264, 266 of the nozzle 250 have surfaces 310, 312, which with facing surfaces 280, 282, define a diverging rectangular nozzle cavity 314.

In operation, the thruster 240 is thought to perform much like the thruster 20. An arc, initiated by a spark from the spark generating apparatus 256, passes through the cavity 308 and the nozzle cavity 314 between the electrodes 252, 254. As the arc passes over the facing surfaces 296, 298 of the bars 246, 248, the arc heats the propellant material to form a ionized gas or plasma. As described above, it is theorized that the plasma moves through the cavity 308 and the nozzle cavity 314 in a direction parallel to the current path between electrodes 252, 254. It is also thought that the plasma is accelerated primarily by electrothermal effects, but also experiences significant acceleration through electromagnetic effects.

Still other aspects, objects, and advantages of the present invention can be obtained from a study of the specification, the drawings, and the appended claims.

We claim:

1. A thruster comprising:

a body having a cavity with a discharge end;

a diverging nozzle which is at least in part non-ablating and substantially electrically insulating and which has an inlet disposed adjacent to the discharge end and an outlet;

a first electrode disposed within the cavity;

a second electrode disposed adjacent to the outlet of the nozzle;

an electric power supply connected to the first and second electrodes to generate an electric arc having a current path therebetween, a non-gaseous, non-liquid propellant material that forms an ionized gas as an incident of being heated, the propellant material being heated by the electric arc to produce an ionized gas in the cavity, the electric power supply including a pulse forming network circuit coupled to the first and second electrodes so that in a first operational mode an electric arc is generated between the first and second electrodes having a current path through the cavity and the nozzle while the ionized gas is passing through the nozzle.

2. The thruster according to claim 1, wherein the non-gaseous, non-liquid propellant material defines at least a portion of the cavity.

3. The thruster according to claim 1, wherein the nozzle is made of boron nitride.

4. The thruster according to claim 1, wherein the electric power supply has incorporated therein a pulse forming network to generate an electric discharge for a predetermined pulse width and at a predetermined repetition rate between the first and second electrodes to generate the electric arc having the current path through the cavity, the predetermined pulse width being between approximately 1 and 100 microseconds and the repetition rate being between approximately 0.1 and 10 Hz.

5. The thruster according to claim 1, wherein the cavity comprises a cylindrical cavity of substantially constant diameter.

6. A thruster comprising:

a body having a cavity with a discharge end and a first passage formed therein in communication with the cavity;

a diverging nozzle which is at least partially non-ablating and substantially electrically insulating and which has an inlet disposed adjacent to the discharge end and an outlet;

a first electrode disposed within the cavity;

a second electrode disposed adjacent to the outlet of the nozzle;

an electric power supply connected to the first and second electrodes to generate an electric arc having a current path therebetween; and a non-gaseous, non-liquid propellant material that forms an ionized gas as an incident of being heated, the propellant material being heated by the electric arc to produce a pressurized, ionized gas in the cavity, the propellant material having a bar form, the bar disposed in the first passage with a first surface of the bar defining at least a portion of the cavity.

7. The thruster according to claim 6, further comprising means for feeding the bar of propellant material through the passage towards the cavity as the propellant material is heated to produce an ionized gas.

8. The thruster according to claim 7, wherein the means for feeding the bar of propellant material into the passage comprises a spring with spaced ends, with one end of the spring attached to the body and the other end of the spring abutting a surface of the bar of propellant material.

9. The thruster according to claim 6, wherein:

the body has a plurality of passages formed therein, the plurality of passages in communication with the cavity; and the propellant material comprises a plurality of bars, the plurality of bars disposed in the plurality of passages, each bar having a surface which defines at least a portion of the cavity.

10. The thruster according to claim 9, wherein:

the first electrode extends at least partially into the cavity and is disposed between the surfaces of at least two of the bars which define at least a portion of the cavity;

the surfaces of at least two bars and a surface of the first electrode at least partially define the cavity.

11. The thruster according to claim 9, further comprising means for feeding the plurality of bars of propellant material through the plurality of passages towards the cavity as the propellant material is heated to produce ionized gas.

12. A thruster comprising:

a body having a cavity with a discharge end;

a diverging nozzle which is at least partially non-ablating and substantially electrically insulating and which has an inlet disposed adjacent to the discharge end and an outlet;

a first electrode disposed within the cavity;

a second electrode disposed adjacent to the outlet of the nozzle;

an electric power supply connected to the first and second electrodes to generate an electric arc having a current path therebetween;

a non-gaseous, non-liquid propellant material that forms an ionized gas as an incident of being heated, the propellant material being heated by the electric arc to produce a pressurized, ionized gas in the cavity; and means for generating an electric spark adjacent to the outlet of the nozzle, the spark initiating the generation of the electric arc between the first and second electrodes.

13. The thruster according to claim 12, wherein the cavity comprises a cylindrical cavity of substantially constant diameter.

14. The thruster according to claim 6, further comprising a pair of D-shaped pieces disposed within the body, the D-shaped pieces defining a part of the cavity.

15. The thruster according to claim 6, wherein the cavity comprises a cylindrical cavity of substantially constant diameter.

16. A method of producing plasma to be used to propel a mass comprising the steps of:

providing a cavity with a discharge end;

providing a diverging nozzle which is at least partially non-ablating and substantially electrically insulating and has an inlet disposed adjacent to the discharge end and an outlet;

providing a non-gaseous, non-liquid propellant material that forms an ionized gas as an incident of being heated;

generating an electric arc having a current path through the cavity and the nozzle between a first electrode disposed in the cavity and a second electrode adjacent the nozzle outlet; and heating the propellant material to produce an ionized gas in the cavity; and expelling the ionized gas from the cavity through the nozzle while generating the electric arc having a current path between the electrodes and through the cavity and the nozzle.

17. The method according to claim 16, wherein the step of providing a non-gaseous, non-liquid propellant material includes the step of providing a non-gaseous, non-liquid propellant material that defines at least a portion of the cavity.

18. The thruster according to claim 16, wherein the cavity comprises a cylindrical cavity of substantially constant diameter.

19. A thruster comprising:

first, upstream and second, downstream spaced electrodes defining a space;

a non-gaseous, non-liquid propellant disposed in the space with a surface which defines at least in part an ionized propellant generation region within the space which the first electrode is disposed in and which has an outlet;

a first non-ablating, electrically insulating diverging wall disposed in the space with a surface which defines an acceleration region within the space having an inlet adjacent to the outlet of the ionized propellant generation region and an outlet adjacent to the second electrode; and an electric power supply coupled to the first and second electrodes to generate an electric arc having a current path therebetween to ablate the propellant to produce an ionized propellant, the electrical energy supply including a pulse forming network circuit having an operational mode wherein an electric arc is generated between the first and second electrodes having a current path through the space while the ionized propellant accelerates in the acceleration region.

20. The thruster according to claim 19, wherein the non-ablating insulating wall is made of boron nitride.

21. The thruster according to claim 19, wherein the pulse forming network generates an electric discharge for a predetermined pulse width and at a predetermined repetition rate between the first and second electrodes to generate the electric arc having the current path through the space, the predetermined pulse width being between approximately 1 and 100 microseconds and the repetition rate being between approximately 0.1 and 10 Hz.

22. The thruster according to claim 19, wherein the surface of the non-gaseous, non-liquid propellant defines a cylindrical cavity of substantially constant diameter.

23. The thruster according to claim 19, further including:

a second non-ablating, electrically insulating wall which with the non-gaseous, non-liquid propellant defines the ionized propellant generation region, the wall having an opening therethrough, the non-gaseous, non-liquid propellant having a bar form, the bar disposed through the opening with a first surface of the bar at least in part defining the ionized propellant generation region.

24. The thruster according to claim 23, wherein:

the opening in the second non-ablating, electrically insulating wall has spaced upstream and downstream ends, the bar disposed through the opening such that the first surface also has spaced upstream and downstream ends exposed to the electric arc generated in the operational mode of the pulse forming network circuit.

* * * * *